US005944212A

United States Patent [19]

Chang

[11] Patent Number: 5,944,212

[45] Date of Patent: Aug. 31, 1999

[54] CONTAINER CAPABLE OF BEING EVACUATED BY ROTATING A CAP MEMBER THEREOF

[76] Inventor: Chin-Der Chang, 3F, No. 32, Alley 19, La. 397, Ming-Shui Rd., Lin 21, Yung-An Li, Chung-Shan Dist., Taipei City, Taiwan

[21] Appl. No.: 08/917,836

[22] Filed: Aug. 27, 1997

[30] Foreign Application Priority Data

May 16, 1997 [TW] Taiwan ..... 86207973

[51] Int. Cl.[6] ..... B65D 41/04; B65D 41/17

[52] U.S. Cl. ..... 220/212; 215/228; 215/262; 220/203.04; 220/360; 220/DIG. 16

[58] Field of Search ..... 215/228, 260, 215/262, 270; 220/203.05, 203.04, 203.06, 231, 235, 212, 257, 303, 360, 367.1, 371; 417/545

*Primary Examiner*—Allan N. Shoap
*Assistant Examiner*—Joe Merek
*Attorney, Agent, or Firm*—Finnegan, Henderson, Farabow, Garrett & Dunner, L.L.P.

[57] ABSTRACT

A container includes a container body, a cap member, a disk member and an evacuating unit. The cap member is mounted on a top open end of the container body and is rotatable about a vertical axis. The disk member is provided beneath and inside the cap member to sealingly close the top open end. The disk member has a downward hollow mounting portion in fluid communication with the top open end. The evacuating unit is operable by the cap member for evacuating air from the container body, and is coupled with the disk member. The evacuating unit has a piston mounted on the downward hollow mounting portion. The piston is movable upward and downward in the downward hollow mounting portion via rotation of the cap member so as to suck out air from the container body.

15 Claims, 9 Drawing Sheets

CONTAINER CAPABLE OF BEING EVACUATED BY ROTATING A CAP MEMBER THEREOF

BACKGROUND OF THE INVENTION

1. Field of the Invention

This invention relates to a container, more particularly to a container having a cap member which can be rotated in order to evacuate air in the container.

2. Description of the Related Art

Referring to FIG. 1, a conventional container is shown to comprise a container body 1 and a lid 12 disposed on a top open end of the container body 1. A piston type pumping device 11 is mounted on the lid 12 in order to suck out air from the container, thereby resulting in a vacuum in the container. Therefore, the contents in the container can be protected from moisture in the air, thereby prolonging the shelf life of the contents. However, the pumping device 11 is bulky, and a large working space is required when the pumping device 11 is operated.

SUMMARY OF THE INVENTION

The object of the present invention is to provide a container having an air-evacuating means which is compact and which requires a minimal working space when operated.

According to the present invention, a container comprises a container body, a cap member, a disk member and evacuating means. The cap member is mounted on a top open end of the container body and is rotatable about a vertical axis. The disk member is provided beneath and inside the cap member to sealingly close the top open end. The disk member has a downward hollow mounting portion in fluid communication with the top open end. The evacuating means is operable by the cap member for evacuating air from the container body and is coupled with the disk member. The evacuating means has a piston mounted on the downward hollow mounting portion. The piston is movable upward and downward in the downward hollow mounting portion via rotation of the cap member so as to suck out air from the container body.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
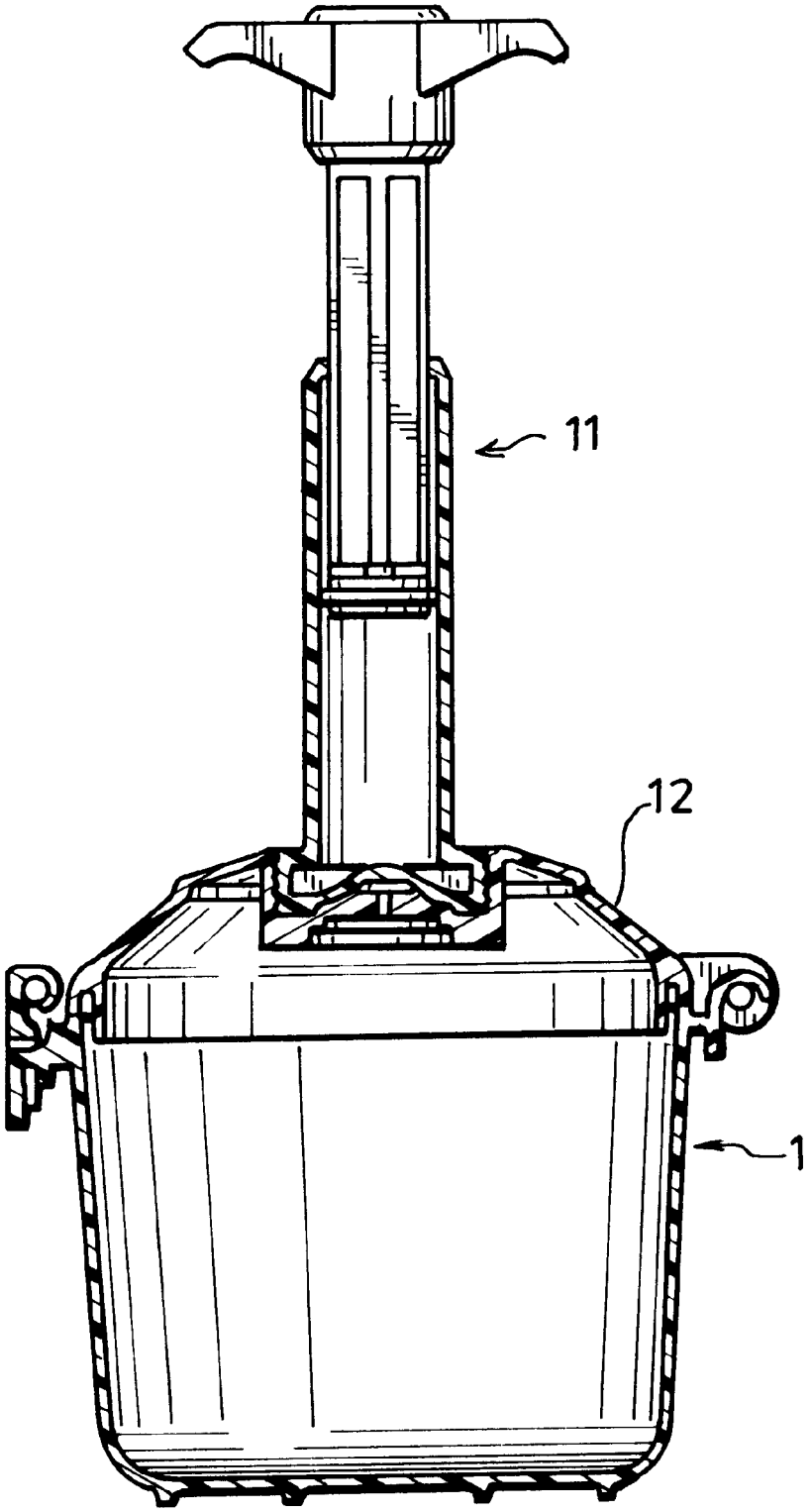
FIG. 1 PRIOR ART
FIG. 1 is a longitudinal sectional view of a conventional container.

Before the present invention is described in greater detail, it should be noted that like elements are denoted by the same reference numerals throughout the disclosure.

Figure 2:
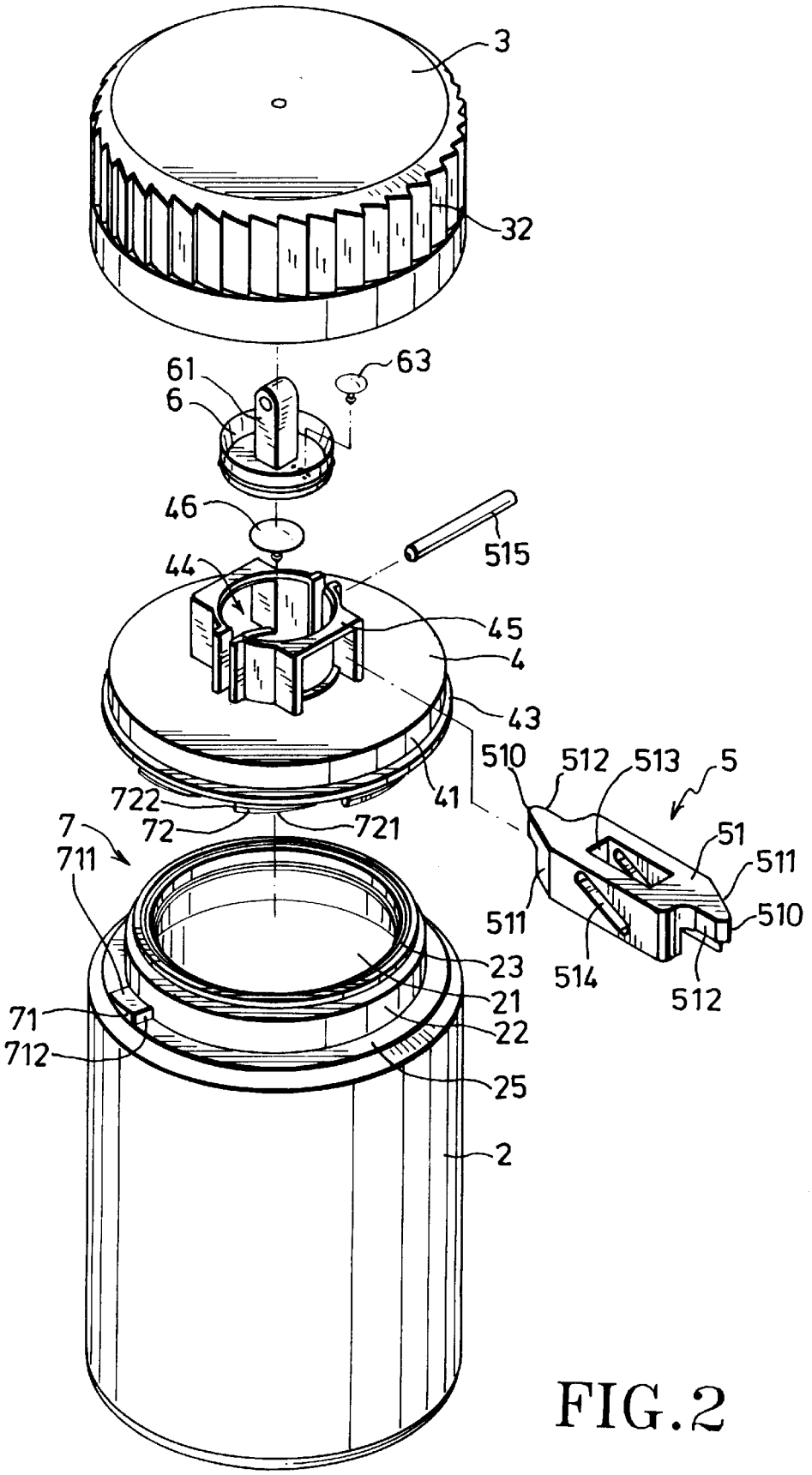
FIG. 2 is an exploded view of a first preferred embodiment of a container according to the present invention.
Figure 3:
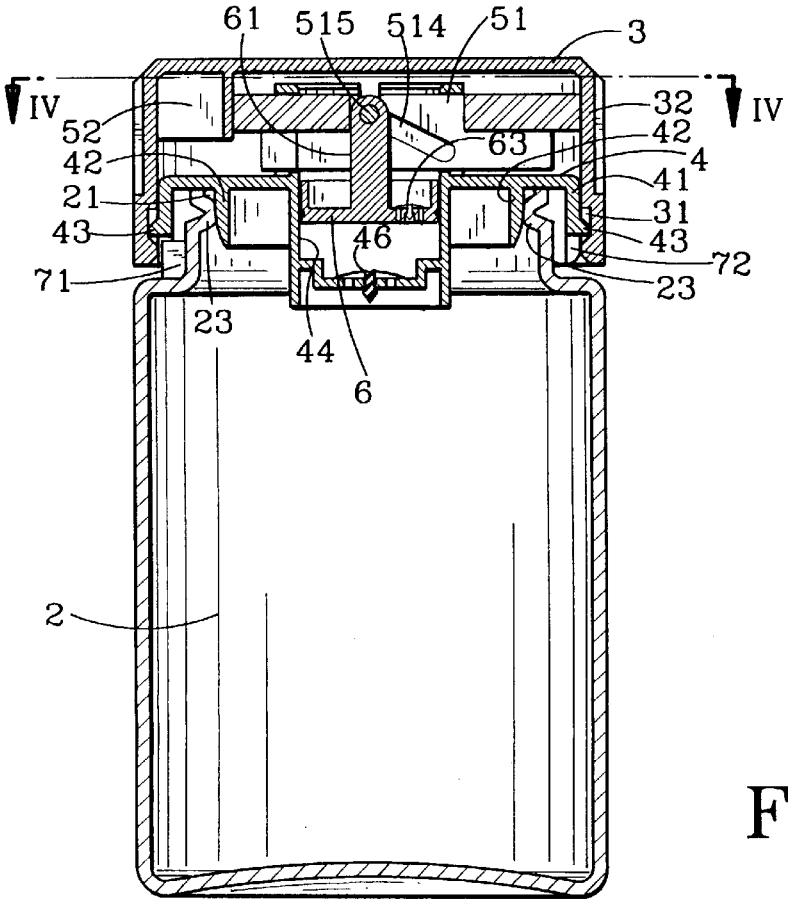
FIG. 3 is a longitudinal sectional view of the first preferred embodiment.

Referring to FIGS. 2 and 3, the first preferred embodiment of a container according to the present invention is shown to comprise a container body 2, a cap member 3, a disk member 4 and evacuating means.

The container body 2 has a top open end 21, a diameter-reduced portion 22 formed adjacent to the top open end 21, and an annular lip 23 formed on an internal face of the diameter-reduced portion 22. The cap member 3 is mounted on the top open end 21 of the container body 2 and is rotatable about a vertical axis. The cap member 3 has an annular wall 32 and an annular groove 31 formed in the annular wall 32 around the disk member 4. The disk member 4 is provided beneath and inside the cap member 3 to sealingly close the top open end 21. The disk member 4 has an annularly and downwardly extending peripheral flange 41 which is formed with an annular projection 43 that projects outwardly and radially into the annular groove 31 of the cap member 3, a downward hollow mounting portion 44 in fluid communication with the top open end 21, and an upward hollow mounting portion 45 fixed above the downward hollow mounting portion 44. The disk member 4 has a seal member 42 which contacts tightly the top open end 21. In this embodiment, the seal member 42 is formed as a hollow insert member which extends downward from the disk member 4 around the downward hollow mounting portion 44 and which engages the annular lip 23 for press-fitting sealingly in the top open end 21 of the container body 2.

The evacuating means is operable by the cap member 3 for evacuating air from the container body 2 and is coupled with the disk member 4, which will be described hereinbelow. The evacuating means has a piston 6 which is mounted on the downward hollow mounting portion 44. The piston 6 is movable upward and downward in the downward hollow mounting portion 44 via rotation of the cap member 3 so as to suck air out from the container body 2. The evacuating means further has a check valve 46 mounted on the bottom of the downward hollow mounting portion 44 in order to permit only an outflow of air from the container body 2 upon reciprocation of the piston 6, and reciprocating means 5 provided above the disk member 4 for reciprocating the piston 6. A second check valve 63 is mounted on the piston 6 which permits only an outflow of air from the downward hollow mounting portion 44.

Figure 4:
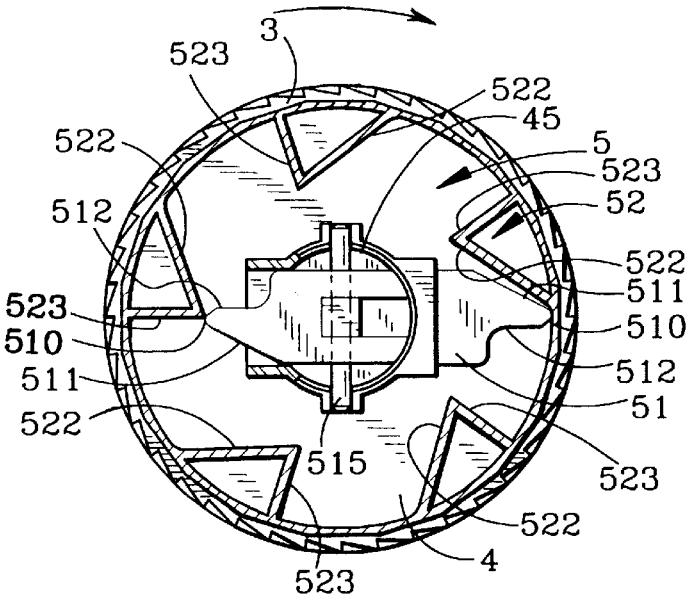
FIG. 4 is a cross-sectional view of the first preferred embodiment taken along line IV—IV in FIG. 3.

Referring to FIGS. 2, 3 and 4, the reciprocating means 5 comprises a plurality of projections 52 formed on the cap member 3 at angular intervals around the upward hollow mounting portion 45, an elongated slider 51 mounted in the upward hollow mounting portion 45 and slidable along a length of the slider 51, and a piston rod 61 extending upward from the piston 6. Each of the projections 52 has a first cam face 522. The slider 51 has two diametrically opposed ends 510, a through hole 513 formed axially of the cap member 3 between the opposed ends 510 for receiving the piston rod 61, two aligned grooves 514 which are formed in two sides of the through hole 513 and which are inclined with respect to the vertical axis of rotation of the cap member 3, and a pin member 515 which extends substantially horizontally through the aligned grooves 514 and the piston rod 61. Each of the opposed ends 510 of the slider 51 has a first cam follower face 511. The first cam follower faces 511 of the opposed ends 510 are pushed alternately by the first cam faces 522 of the projections 52, thereby reciprocating the slider 51 when the cap member 3 is rotated in a first direction, i.e. the clockwise direction, as best illustrated in FIG. 4. Upon the reciprocation of the slider 51, the piston 6 is moved upward and downward in the downward hollow mounting portion 44 in order to suck air out of the container body 2 through the check valves 46, 63 as described hereinbefore.

Figure 6:
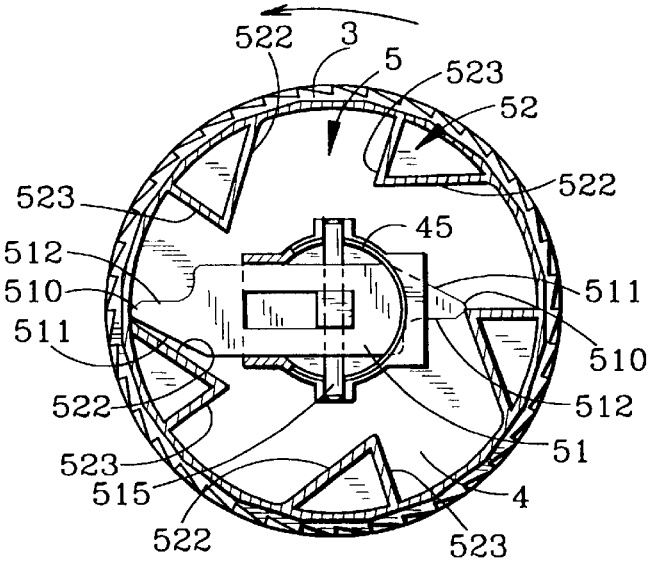
FIG. 6 is a cross-sectional view of the preferred embodiment taken along line VI—VI in FIG. 5.
Figure 5:
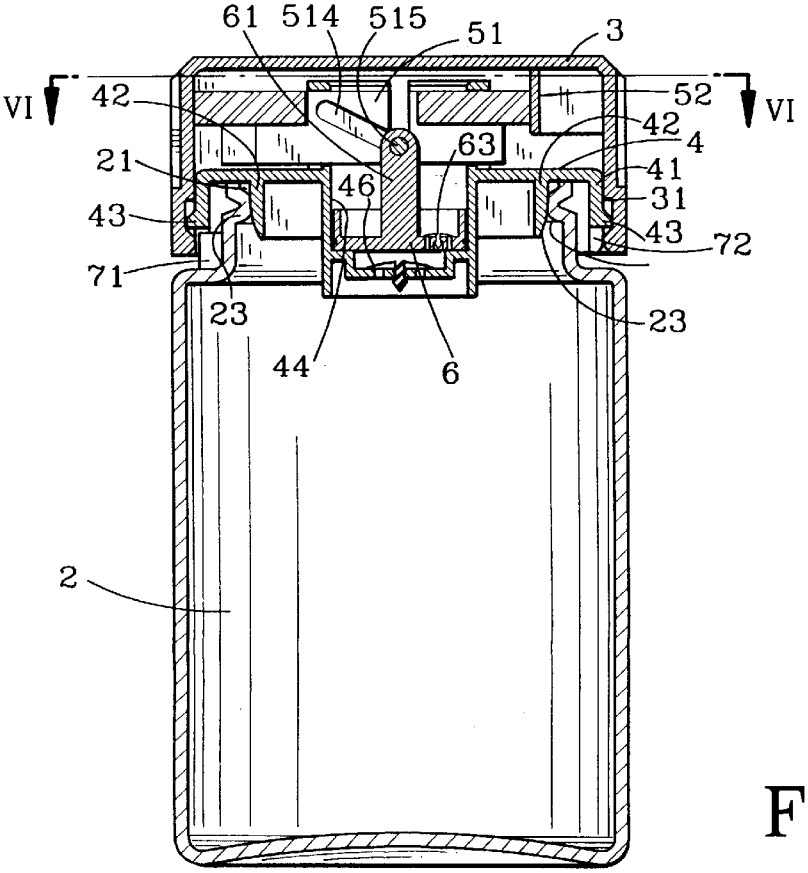
FIG. 5 is another longitudinal sectional view of the first preferred embodiment.

A plurality of first thrust faces 523 are formed respectively on the projections 52 and serve as rotating means for rotating the disk member 4 when the cap member 3 is rotated in a second direction which is opposite to the first direction, i.e. the counterclockwise direction. The opposed ends 510 of the slider 51 has engaging faces 512 that are engageable with the first thrust faces 522 when the cap member 3 is rotated in the second direction, as best illustrated in FIGS. 5 and 6. Therefore, the disk member 4 can be rotated with the cap member 3 when the cap member 3 is rotated in the second direction.

Referring to FIGS. 2 and 5, the container has disengaging means 7 for disengaging the seal member 42 and the top open end 21 of the container body 2 when the cap member 3 is rotated in the second direction so as to allow an inflow of air into an interior of the container body 2. Therefore, the cap member 3 and the disk member 4 can be removed easily from the container body 2. The disengaging means 7 comprises a cam block 71 formed on a shoulder 25 adjacent to the top open end 21 of the container body 2, and a plurality of protrusions 72 which are spaced annularly on the disk member 4 to be cammed upward by the cam block 71. The cam block 71 has a second cam face 711. Each of the protrusions 72 has a second cam follower face 721. The second cam face 711,pushes the disk member 4 upward when any one of the second cam follower faces 721 of the protrusions 72 slide over the second cam face 711 when the cap member 4 is rotated in the second direction.

The container further has a preventing means for preventing the disk member 4 from rotating relative to the container body 2 when the cap member 3 is rotated in the first direction and the disk member 4 engages sealingly the top open end 21 of the container body 2. The preventing means comprises a second thrust face 712 which is formed on the cam block 71, and a plurality of third thrust faces 722 formed respectively on the protrusions 72. The second thrust face 712 is engageable with any one of the third thrust faces 722 when the cap member 3 is rotated in the first direction.

Figure 7:
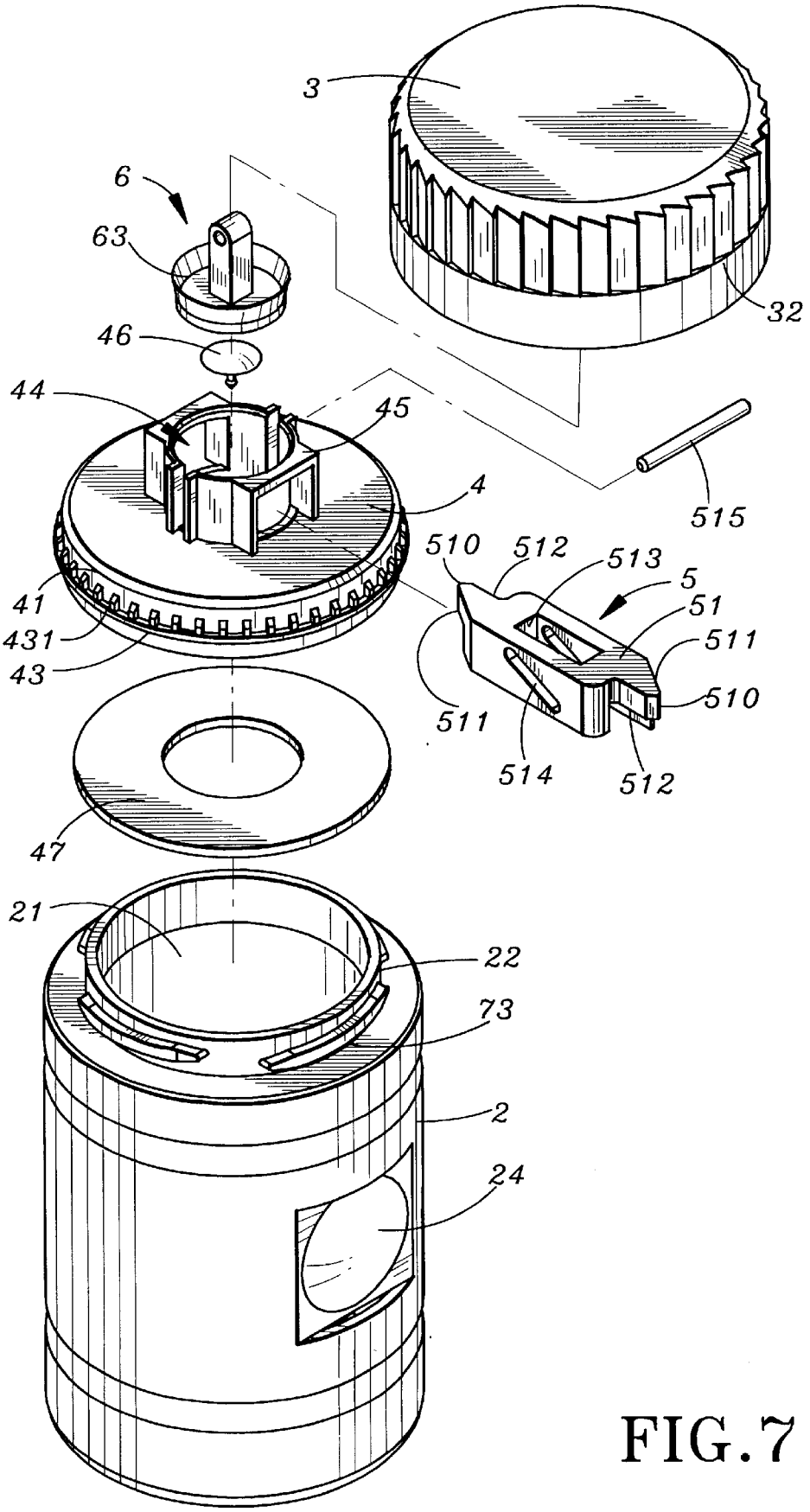
FIG. 7 is an exploded view of a second preferred embodiment of a container according to the present invention.
Figure 8:
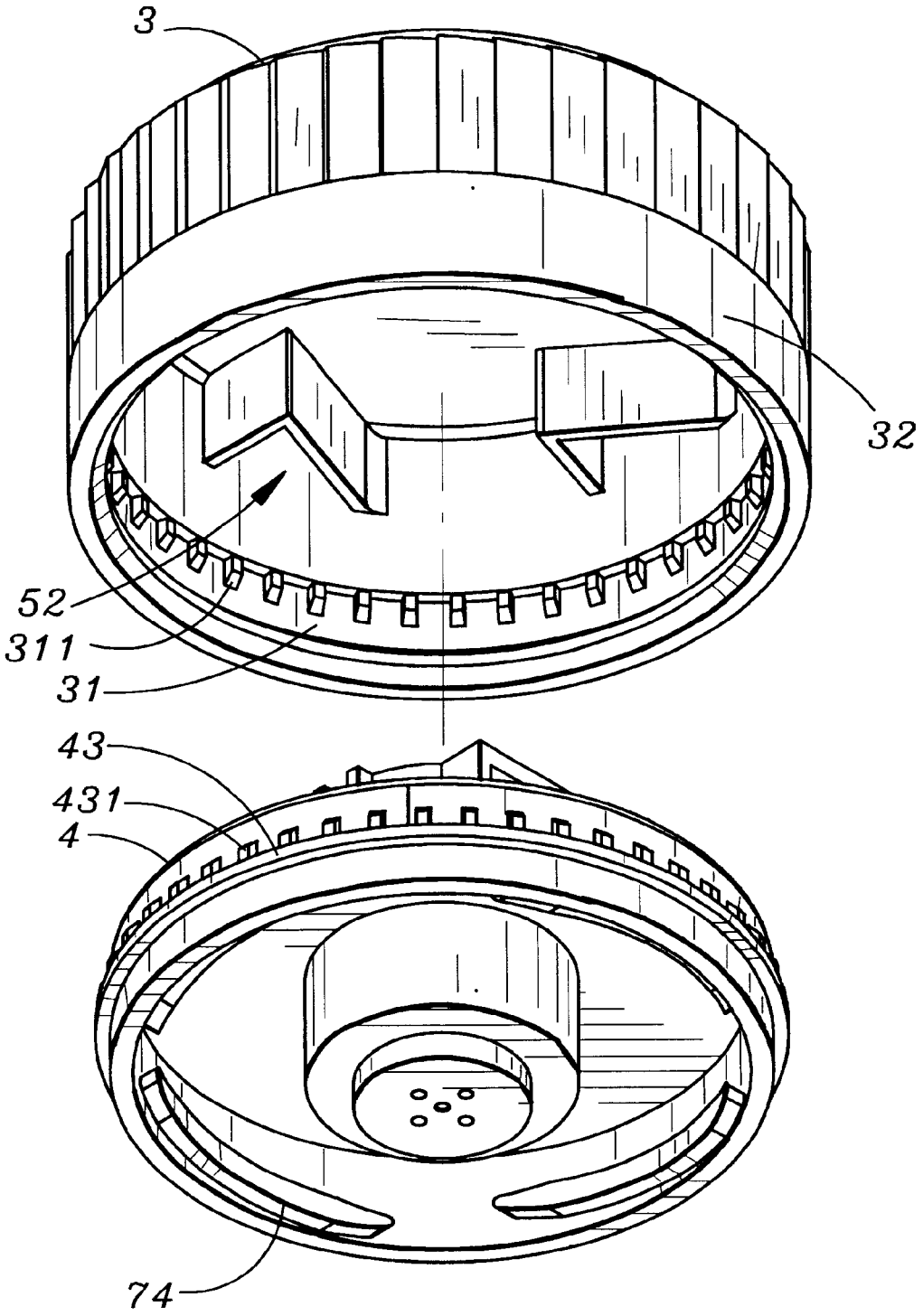
FIG. 8 is an exploded view of a cap member and a disk member of the second preferred embodiment of a container according to the present invention.
Figure 9:
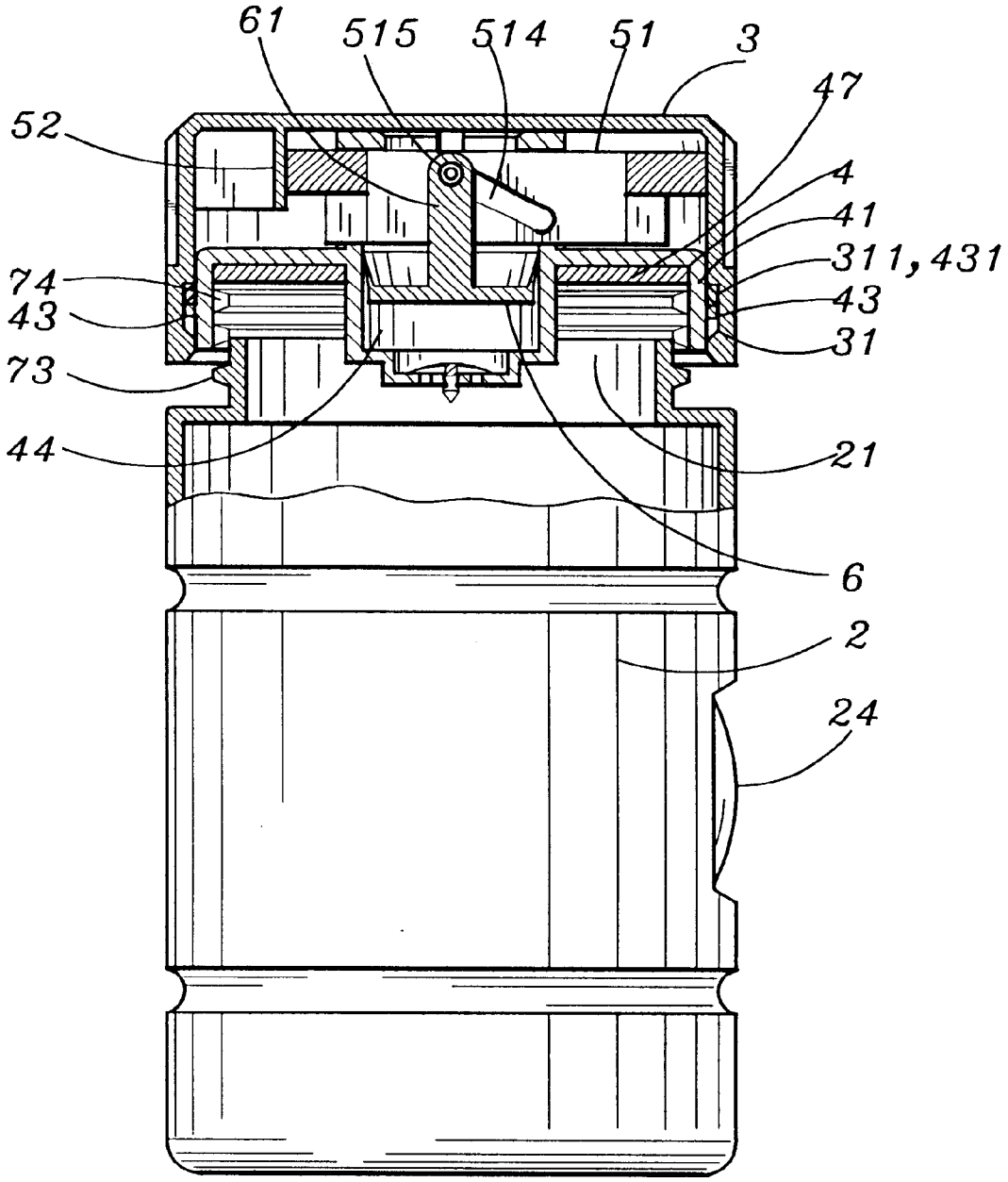
FIG. 9 is a sectional schematic view illustrating how the cap member is disposed initially on a top open end of the container body of the second preferred embodiment.
Figure 11:
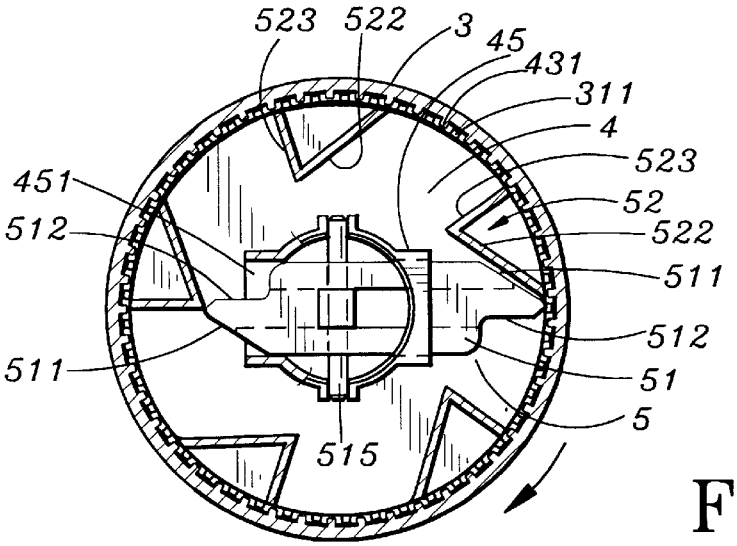
FIG. 11 is a cross-sectional view of the second preferred embodiment taken along line XI—XI in FIG. 10.

Referring to FIG. 7, a second preferred embodiment of a container according to the present invention is shown to comprise a container body 2, a cap member 3, a disk member 4 and evacuating means. In this embodiment, the cap member 3 has an annular wall 32 and an annular groove 31 which is formed in the annular wall 32 around the disk member 4, as best illustrated in FIG. 8. The disk member 4 has an annularly and downwardly extending peripheral flange 41 which is formed with an annular projection 43 that projects outwardly and radially into the annular groove 31 of the cap member 3. The container further comprises first teeth 431 which extends radially outward from the disk member 4, and second teeth 311 which extends radially from the annular wall 32 in the annular groove 31 to engage the first teeth 431 when the cap member 3 is disposed on the top open end 21 of the container body 2, as best illustrated in FIG. 9. Therefore, the disk member 4 can be initially rotated with the cap member 3 when the cap member 3 begins to rotate in the first direction. The first and second teeth 431, 311 are disengageable from one another when the disk member 4 abuts against the top open end 21 of the container body 2 and moves upward relative to the cap member 3, thereby enabling the cap member 3 to rotate in the first direction independently of the disk member 4.

Figure 10:
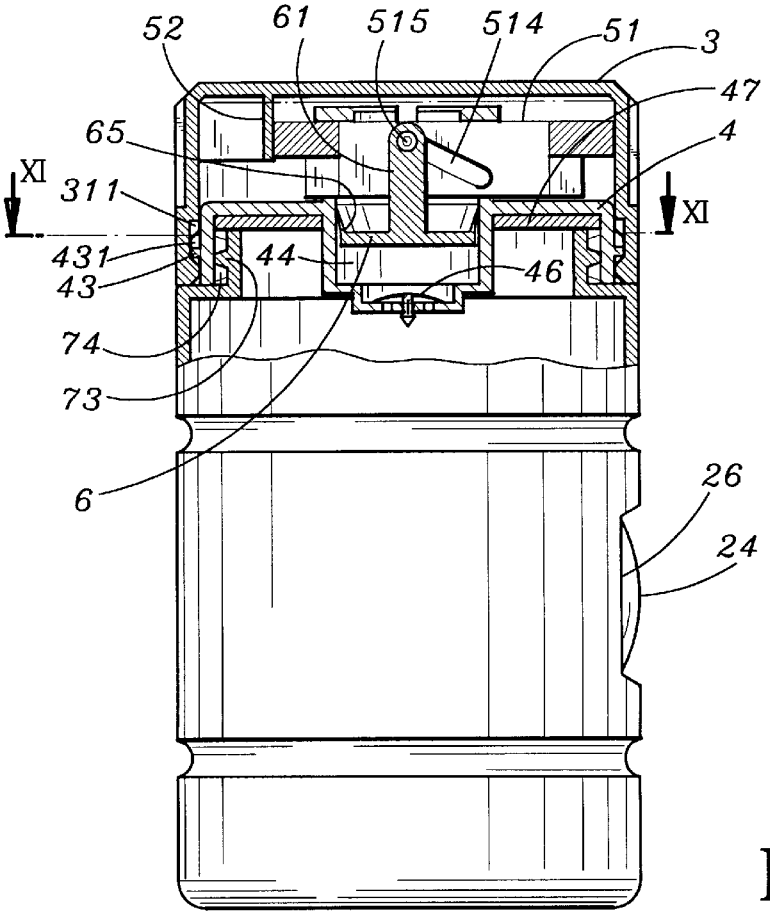
FIG. 10 is a sectional schematic view of the container of the second embodiment in which a piston is in a first position after a disk member engages sealingly the top open end of the container body.
Figure 13:
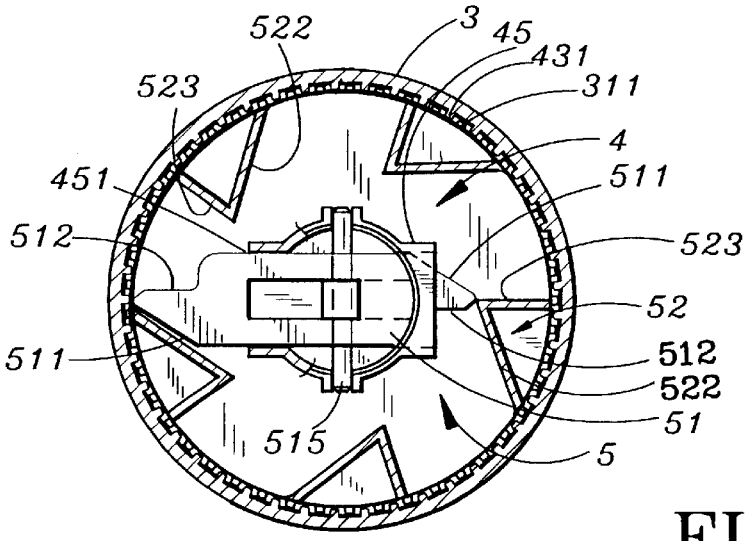
FIG. 13 is a cross-sectional view of the second preferred embodiment taken along a line XIII—XIII in FIG. 12.

The disk member 4 has downward and upward hollow mounting portions 44, 45 similar to those of the container of the first preferred embodiment. In this embodiment, the evacuating means is similar to that of the first preferred embodiment, except that the second check valve 63 is formed as a diaphragm valve which is mounted on the piston 6 and which functions as that of the first embodiment. A first set of helical thread segments 74 is formed on an internal face of the peripheral flange 41 of the disk member 4. The container body 2 has a second set of helical thread segments 73 formed on the diameter-reduced portion 22 thereof. The first and second sets of helical thread segments 74, 73 engage threadedly one another when the cap member 3 is rotated in the first direction, thereby enabling the first and second teeth 431, 331 to disengage one another and serving as a preventing means for preventing the disk member 4 from rotating relative to the container body 2 when the disk member 4 closes sealingly the top open end 21 of the container body 2, as best illustrated in FIG. 10. The disk member 4 further has a seal member 47 which is formed as a seal ring that is attached to the lower face of the disk member 4 and that contacts tightly the top open end 21 of the container body 2. The first and second sets of helical thread segments 74, 73 disengage one another when the cap member 3 is rotated in the second direction, thereby serving as disengaging means for disengaging the seal member 47 and the top open end 21 of the container body 2 so as to allow an inflow of air into an interior of the container.

Figure 12:
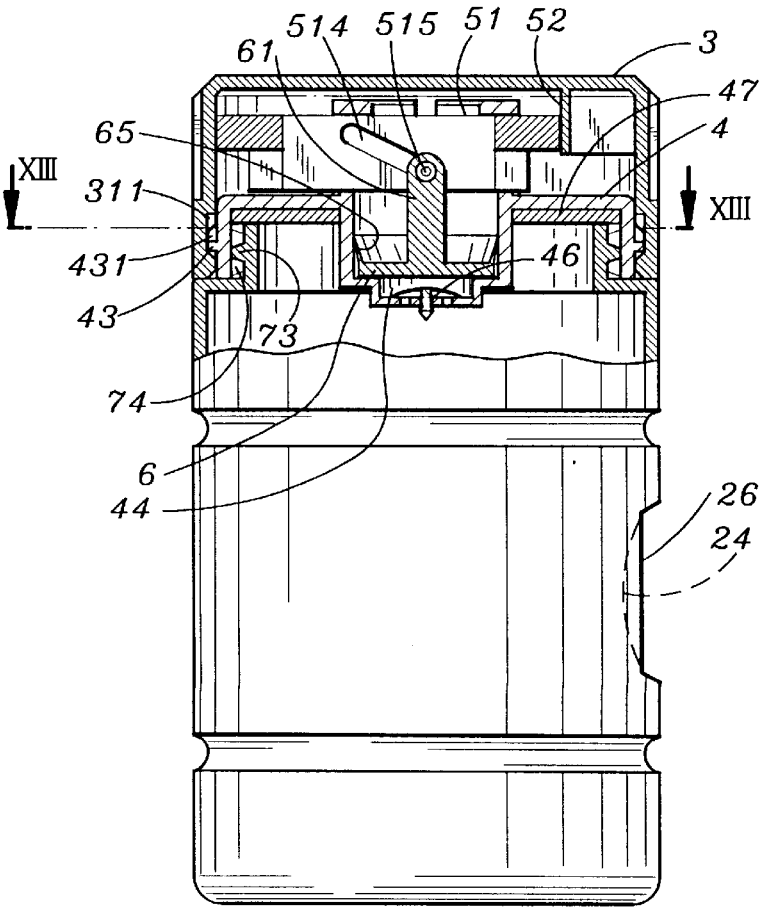
FIG. 12 is a sectional schematic view of the container of the second embodiment in which a piston is moved to a second position by rotating the cap member.

Referring to FIGS. 10 and 12, the container body 2 has a hole 26 and a pressure-indicating diaphragm 24 which seals the hole 26. When air is sucked gradually out of the container body 2, the diaphragm 24 will protrude inwardly into the container body 2 for indicating the air pressure inside the container body 2, as best illustrated in FIG. 12. When the air pressure inside and outside the container body 2 are equal, the diaphragm 24 will protrude outwardly from the container body 2, as best illustrated in FIG. 10.

The operation of the evacuating means is similar to that of the first preferred embodiment. That is, the piston 6 is movable upward and downward in the downward hollow mounting portion 44 via rotation of the cap member 3 in the first direction so as to suck air out from the container body 2 as in the first preferred embodiment, as best illustrated in FIGS. 10, 11, 12 and 13. The cap member 3 and the disk member 4 can be removed easily from the top open end 21 of the container body 2 upon rotation of the cap member 3 in the second direction.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A container comprising:

a container body having a top open end;

a cap member mounted on said top open end of said container body and rotatable about a vertical axis;

a disk member provided beneath and inside said cap member to sealingly close said top open end, said disk member having a downward hollow mounting portion in fluid communication with said top open end; and evacuating means operable by said cap member for evacuating air from said container body and coupled with said disk member, said evacuating means having a piston mounted in said downward hollow mounting portion, said piston being movable upward and downward in said downward hollow mounting portion via rotation of said cap member so as to suck out air from said container body during said rotation.

2. The container as claimed in claim 1, wherein said evacuating means further includes:

a check valve mounted on said downward hollow mounting portion to permit only an outflow of air from said container body upon reciprocation of said piston; and means, provided above said disk member, for reciprocating said piston.

3. The container as claimed in claim 2, further comprising:

means for preventing said disk member from rotating relative to said container body when said cap member is rotated in a first direction and said disk member engages sealingly said top open end of said container body; and means for rotating said disk member when said cap member is rotated in a second direction which is opposite to said first direction.

4. The container as claimed in claim 3, wherein said disk member has a seal member which contacts tightly said top open end of said container body.

5. The container as claimed in claim 4 further comprising means for disengaging said seal member and said top open end of said container body when said cap member is rotated in said second direction so as to allow an inflow of air into an interior of said container body.

6. The container as claimed in claim 4, wherein said seal member includes a hollow insert member which extends downward from said disk member around said downward hollow mounting portion for press-fitting sealingly in said top open end of said container body.

7. The container as claimed in claim 3, wherein said disk member has an upward hollow mounting portion above said downward hollow mounting portion, said reciprocating means comprising a plurality of projections formed on said cap member at angular intervals around said upward hollow mounting portion, an elongated slider mounted on said upward hollow mounting portion and slidable along a length of said slider, and a piston rod extending upward from said piston, each of said projections having a first cam face, said slider having two diametrically opposed ends, a through hole formed axially of said cap member between said opposed ends for receiving said piston rod, two aligned grooves which are formed on two sides of said through hole and which are inclined with respect to the vertical axis of rotation of said cap member, and a pin member which extends substantially horizontally through said aligned grooves and said piston rod, each of said opposed ends of said slider having a first cam follower face, said first cam follower faces of said opposed ends being pushed alternately by said first cam faces of said projections, thereby reciprocating said slider when said cap member is rotated in said first direction.

8. The container as claimed in claim 7, wherein said rotating means comprises a plurality of first thrust faces formed respectively on said projections, said opposed ends of said slider further having engaging faces engageable with said first thrust faces when said cap member is rotated in said second direction.

9. The container as claimed in claim 5, wherein said disengaging means comprises a cam block formed adjacent to said top open end of said container body and a plurality of protrusions which are spaced annularly on said disk member to be cammed upward by said cam block, said cam block having a second cam face, each of said protrusions having a second cam follower face, said second cam face pushing said disk member upward when any one of said second cam follower faces of said protrusions slide over said second cam face when said cap member is rotated in said second direction.

10. The container as claimed in claim 3, wherein said preventing means comprises a second thrust face which is formed on said cam block, and a plurality of third thrust faces formed respectively on said protrusions, said second thrust faces being engageable with any one of said third thrust faces when said cap member is rotated in said first direction.

11. The container as claimed in claim 1, wherein said cap member has an annular wall and an annular groove formed in said annular wall thereof around said disk member, said disk member having an annularly and downwardly extending peripheral flange which is formed with an annular projection that projects outwardly and radially into said annular groove of said cap member.

12. The container as claimed in claim 3, wherein said cap member has an annular wall and an annular groove which is formed in said annular wall around said disk member, said container further comprising first teeth which extends radially outward from said disk member, and second teeth which extends radially from said annular wall to engage said first teeth when said cap member is disposed on said top open end of said container body, said first and second teeth being disengageable from one another when said disk member abuts against said top open end of said container body and moves upward relative to said cap member, thereby enabling said cap member to rotate in said first direction independently of said disk member.

13. The container as claimed in claim 12, wherein said disk member has a first set of helical thread segments formed thereon, said container body having a second set of helical thread segments, said first and second sets of helical thread segments engaging threadedly one another when said cap member is rotated in said first direction, thereby enabling said first and second teeth to disengage one another and serving as said preventing means when said disk member closes sealingly said top open end of said container body, said first and second sets of helical thread segments disengaging one another when said cap member is rotated in said second direction, and serving as said disengaging means.

14. The container as claimed in claim 2, wherein said piston has a diaphragm check valve attached thereto.

15. The container as claimed in claim 1, wherein said container body has a hole and a pressure-indicating diaphragm which seals said hole.

* * * * *